US008899276B2

(12) United States Patent
Takahashi et al.

(10) Patent No.: US 8,899,276 B2
(45) Date of Patent: Dec. 2, 2014

(54) JOINING LOOP STRUCTURE OF INDUSTRIAL MULTILAYER FABRIC

(71) Applicant: Nippon Filcon Co., Ltd., Tokyo (JP)

(72) Inventors: Hiroaki Takahashi, Shizuoka (JP); Mitoshi Baba, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 0 days.

(21) Appl. No.: 13/712,210

(22) Filed: Dec. 12, 2012

(65) Prior Publication Data

US 2013/0206276 A1 Aug. 15, 2013

(30) Foreign Application Priority Data

Feb. 13, 2012 (JP) ..... 2012-028152

(51) Int. Cl.

| | |
|---|---|
| ***D21F 1/12*** | (2006.01) |
| ***D21F 7/10*** | (2006.01) |
| ***D03D 11/00*** | (2006.01) |
| ***D21F 1/00*** | (2006.01) |
| ***D03D 3/00*** | (2006.01) |
| ***D03D 1/00*** | (2006.01) |
| *D03D 25/00* | (2006.01) |

(52) U.S. Cl.

CPC ..... *D03D 3/00* (2013.01); *D03D 11/00* (2013.01); *D21F 1/0054* (2013.01); *D03D 1/0094* (2013.01)

USPC ..... 139/383 AA; 139/383 A; 139/383 R; 162/358.2

(58) Field of Classification Search

CPC ... D21F 1/0036; D21F 1/0027; D21F 1/0045; D21F 1/0054; D21F 7/083; Y10S 162/902; Y10S 384/911; Y10S 162/903; D03D 11/00; D03D 25/00; D03D 2700/0155; D03D 3/04; D03D 3/02; B32B 11/10

USPC ..... 139/383 R, 383 A, 383 AA, 408, 411, 139/412, 413, 414; 162/348, 358.1, 358.2, 162/900, 902, 903, 904

See application file for complete search history.

(56) References Cited

U.S. PATENT DOCUMENTS 2,862,283 A * 12/1958 Rasero ..... 442/207
4,174,739 A * 11/1979 Rasero et al. ..... 139/388

(Continued)

FOREIGN PATENT DOCUMENTS

JP 2000-239941 A 9/2000
JP 2011-087484 A 5/2011

(Continued)

OTHER PUBLICATIONS

Extended European Search Report issued in EP Application No. 13151263.4, dated Apr. 24, 2013.

(Continued)

*Primary Examiner* — Bobby Muromoto, Jr.

(74) *Attorney, Agent, or Firm* — Rader, Fishman & Grauer PLLC

(57) ABSTRACT

A multilayer fabric is joined by engaging joining loops formed at both ends of a disjoined industrial multilayer fabric having wefts and warps in layers. The joining loops are formed by folding back some or all the end portions of warps. The both ends of the fabric are joined by engaging the loops to form a common hole and inserting a core wire into the common hole. At least one upper side weft remains while a lower side weft below the remaining upper side weft is removed at the both ends of the fabric. The common hole and the core wire inserted therein are located below the remaining upper side weft. The folded portions of the warps are interwoven with wefts of a normal portion of the fabric.

9 Claims, 6 Drawing Sheets

(56) References Cited

U.S. PATENT DOCUMENTS

| | | | | |
|---|---|---|---|---|
| 4,755,409 | A * | 7/1988 | Harkness | 428/40.3 |
| 5,188,884 | A | 2/1993 | Smith | |
| 5,360,038 | A * | 11/1994 | Sano | 139/383 AA |
| 6,223,781 | B1 * | 5/2001 | Yamada et al. | 139/383 AA |
| 2002/0060039 | A1 * | 5/2002 | Taipale | 162/348 |
| 2003/0084953 | A1 * | 5/2003 | Burazin et al. | 139/383 A |
| 2003/0085013 | A1 * | 5/2003 | Burazin et al. | 162/289 |
| 2003/0145970 | A1 * | 8/2003 | Ampulski | 162/348 |
| 2007/0044931 | A1 * | 3/2007 | Crook et al. | 162/358.2 |
| 2007/0232170 | A1 | 10/2007 | Atwood et al. | |
| 2010/0119787 | A1 * | 5/2010 | Ueda et al. | 428/196 |

FOREIGN PATENT DOCUMENTS

| | | | |
|---|---|---|---|
| WO | WO-99/19564 | A1 | 4/1999 |
| WO | WO-02/053834 | A1 | 7/2002 |

OTHER PUBLICATIONS

Danby and J Perrault R, "Weaves of papermaking wires and forming fabrics," Pulp & Paper Technical Association of Canada preprint, 90th annual meeting = prétiré, Congrès annuel / Association Technique des pâtes et papiers du Canada, pp. C-147-C-164, XP009166271, ISBN: 1-896742-98-X, Jan. 2004.

* cited by examiner

JOINING LOOP STRUCTURE OF INDUSTRIAL MULTILAYER FABRIC

CROSS-REFERENCES TO RELATED APPLICATION

This application claims priority from Japanese Patent Application No. 2012-028152 filed on Feb. 13, 2012, the contents of which are incorporated herein by reference in their entireties.

BACKGROUND OF THE INVENTION

1. Field of the invention

The present invention relates to a joining loop structure of an industrial multilayer fabric for preventing exposure of lower side warps from the surface of the fabric, in particular, a joining structure of an airlaid multilayer fabric.

2. Description of the Related Art

As industrial fabrics, many fabrics, for example, paper manufacturing fabrics such as a paper making fabric and a paper making canvas, nonwoven cloth manufacturing fabrics, sludge dewatering fabrics, building material manufacturing belts, and conveyor belts have heretofore been known. At present, these industrial fabrics are processed as endless ones and used after attached to individual machines such as a paper making machine and a dehydrator.

Examples of a method of obtaining an endless industrial fabric by processing include a method of connecting both ends of an industrial fabric by weaving, a method of engaging loops formed on both ends by using the warp of the industrial fabric itself with each other and inserting a joining core wire through a common hole of these loops, a method of engaging spiral loops installed at both ends of the industrial fabric with each other and inserting a core wire through these loops, and a method called clipper lacing, in which metal hooks attached to both ends of the fabric are engaged with each other and then, a core wire is inserted through the resulting hooks. These known methods are employed, depending on their intended use.

Particularly, in the method of engaging loops formed at both ends of an industrial fabric with each other, thereby obtaining an endless fabric, an endless fabric or a disjoined fabric can be made freely by inserting or extracting the joining core wire. If an endless fabric or a disjoined fabric can be made freely, it is possible to extend the disjoined fabric between rollers of a device and then make the fabric endless while having it between rollers. Thus, using this method enables very easy and efficient attachment of the fabric to the device.

For example, the device can be operated after an old used industrial fabric attached to the device is formed to have ends and one end of a new industrial fabric to be attached is joined to one end of the old fabric. The industrial fabric is moved and extended between the rollers of the device and after confirmation that the fabric is moved around and entirely extended, the old industrial fabric is removed and thus, the new industrial fabric can be attached in an endless manner.

On the other hand, in the method of joining both ends of an industrial fabric by weaving, by which an endless or disjoined industrial fabric cannot be formed freely, a so-called cantilever system should be employed. In this system, the rollers of the device are supported on one side, supports and other obstacles are removed from the other side, and the industrial fabric is inserted and extended in a width direction from one side of the device. However, using the cantilever system for joining has such a disadvantage as an increase in the manufacture cost of the machine, because the machine itself requires a special structure for attaching or removing the fabric. In addition, disadvantages such as increase in the size of the device and requirement of a wide space for installing the device have also been pointed out. Moreover, when a very heavy or long industrial fabric is used, the system is unsuited because it is difficult to insert the fabric.

The above-described cantilever system is therefore not employed now in most cases excluding paper making fabrics used in the paper making section of a paper making machine in which surface smoothness is regarded as very significant. As the method of forming an endless fabric, a method of forming a spiral loop or a metal hook at the end portion which method permits formation of the fabric in a disjoined form again is employed.

In the above-mentioned method, however, a spiral wire or metal hook made of a material utterly different, in structure or materials, from a yarn constituting an industrial fabric should be attached. Even if a loop is formed, the loop formation portion differs from a normal portion and the loop protrudes from the end portion. Thus, the structure of a joining portion is completely different from that of the normal portion.

As the two-layer fabric for nonwoven cloth described in Japanese Patent Application No. 2011-87484, industrial double-layer fabrics obtained by binding an upper side fabric and a lower side fabric with a binding yarn are known. Such a fabric is used in the manufacturing method of a nonwoven cloth so that different yarns are used for the upper side fabric and the lower side fabric, respectively. Described specifically, in the double-layer fabric for nonwoven cloth described in Japanese Patent Application No. 2011-87484, the upper side fabric is made of a fluorine-based resin to prevent fouling and the lower side fabric is made of a general yarn such as polyethylene terephthalate (PET) to satisfy requirements in physical properties such as rigidity.

When a loop is formed as a joining structure of both ends of such an industrial fabric, a difference in the structure between the loop formation portion and the normal portion becomes a problem. In the case of Japanese Patent Application No. 2011-87484, since the loop formation portion should be made of a yarn such as PET stronger than a fluorine-based resin, the loop is formed with the lower side warp. In the loop formation portion, however, the lower side warp made of PET or the like is exposed from the surface, which deteriorates the effect and advantage of the upper side fabric made of a fluorine-based resin to prevent fouling.

As the joining portion described in Japanese Patent No. 3938817, on the other hand, a joining loop structure in which a loop formation portion is positively hided with an upper side weft is known. An object of the invention described in Japanese Patent No. 3938817 which is related to a joining loop, however, is to form the loop formation portion and the normal portion without causing a significant difference between them. No consideration is given to prevent exposure of the lower side fabric from the surface so that this invention has the disadvantage that the lower side warp constituting the loop is exposed from the surface.

SUMMARY OF THE INVENTION

The invention has been made in view of the above-mentioned problems and an object of the invention is to provide a joining structure of an industrial multilayer fabric capable of preventing exposure of both a loop formation portion and a yarn constituting a lower side fabric from the surface of the fabric, though a joining method employed here forms joining loops capable of freely forming an endless or disjoined fabric and at the same time, engaging the loops with each other to make the fabric endless.

Another object of the invention is to provide a joining structure of an industrial multilayer fabric capable of reinforcing the joining strength of the industrial multilayer fabric at the loop formation portion and preventing extension of the loop formation portion.

The joining loop of the industrial multilayer fabric according to the invention has a structure preventing exposure of a lower side fabric from the surface of the fabric. The joining loop structure according to the invention is characterized in that it employs the following structure in order to overcome the problems of the related art.

A joining loop structure of an industrial multilayer fabric is obtained by forming, at both end portions of a disjoined industrial multilayer fabric having wefts and warps arranged in layers, joining loops by folding back some or all the end portions of warps and joining the both end portions. A core wire is inserted into a common hole of the joining loops formed by engaging the joining loops at the both end portions of the fabric. The joining loop structure is also formed by leaving at least one surplus or remaining upper side weft at the both end portions of the industrial multilayer fabric and removing a weft located below the remaining upper side weft to form a space for the common hole of the joining loops. The common hole of the joining loops is formed by folding back all or some of lower side warps at one end portion or both end portions of the industrial multilayer fabric and interweaving the folded-back warps in a normal portion of the fabric. The folded-back warps are not necessary interwoven with the remaining upper side weft. The common hole of the joining loops through which the core wire is inserted is formed below the remaining upper side weft.

The joining loop structure may contain three common holes of joining loops through each of which a core wire is inserted. One of the three common holes may be obtained by leaving two upper side remaining wefts at the both end portions of the industrial multilayer fabric, forming the one common hole of upper-side joining loops between the two upper side remaining wefts of the both ends, and folding back all or some of upper side warps at the both end portions of the industrial multilayer fabric and interweaving the folded-back warp in a normal portion without interweaving with a lower side weft. Two of the three common holes may be formed by engaging lower-side joining loops after removal of lower side wefts located below the two upper side remaining wefts. The two common holes of the lower-side joining loops are formed by folding back all or some of lower side warps at both end portions of the industrial multilayer fabric and interweaving the folded-back warps in a normal portion of the fabric without interweaving with the upper side remaining wefts.

The industrial fabric may be a double-layer fabric obtained by binding an upper side fabric and a lower side fabric with a weft binding yarn.

A yarn constituting the upper side fabric may be made of a fluorine resin and a yarn constituting the lower side fabric may be made of a yarn different from that constituting the upper side fabric.

The industrial fabric may be an airlaid multilayer fabric.

The joining loop structure of an industrial multilayer fabric according to the invention can prevent exposure of both a loop formation portion and a lower side fabric from the surface of the fabric, though in this structure, joining loops of a fabric capable of freely changing the fabric to an endless one or disjoined one are formed and at the same time, these loops are engaged with each other to make the fabric endless.

Moreover, the joining loop structure according to the invention produces excellent effects of reinforcing the joining strength of the industrial multilayer fabric at the loop formation portion and preventing extension of the loop formation portion.

DESCRIPTION OF THE PREFERRED EMBODIMENT

Figure 1:
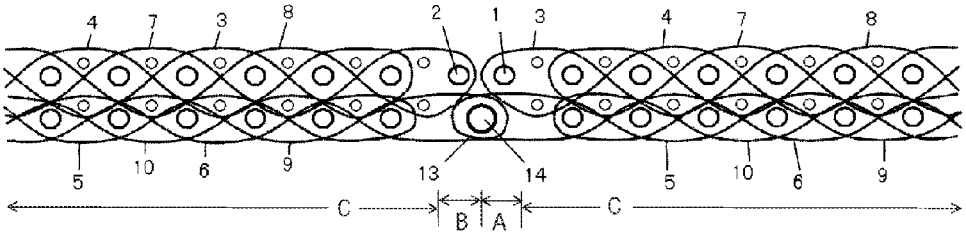
FIG. 1 is a conceptual diagram showing a joining loop according to Embodiment 1 of the invention.

The joining loop structure of an industrial multilayer fabric according to the invention will hereinafter be described and next, embodiments of the joining loop structure of an industrial multilayer fabric according to the invention will be described in detail referring to drawings.

In the joining loop structure of an industrial fabric according to the invention, a loop formation portion is formed by leaving at least one upper side weft at the end of the fabric and removing a lower side weft below the remaining upper side weft. In the loop formation portion, all or some of upper side warps at one side end or both side ends of the fabric are folded back into loops and the resulting loops are each interwoven with a lower side weft as needed to form joining loops. A plurality of the resulting loops is engaged with each other to form, below the upper side weft, a common hole in the joining loop structure for inserting therethrough a core wire.

When the above-mentioned constitution is employed, an upper side weft is present, as in the normal portion, on the upper side of the common hole formed by engaging joining loops with each other, that is, on the upper-layer surface of the joining so that neither joining loop nor lower side warp placed on the lower surface side is exposed from the surface of the fabric.

The term "joining loop" as used herein means a loop that forms a common hole for inserting therethrough a core wire or the like and does not only mean a folded-back warp having only a function of holding a weft at the end. In addition, the loop formation portion is placed at a site which is below the remaining upper side weft and from which a lower side weft has been removed. It is formed at this site with a lower side warp.

The term "normal portion" in the joining loop structure of an industrial multilayer fabric according to the invention is a portion of the fabric which is not a joining portion.

The warp which has been folded back to form a loop is interwoven in the normal portion where a warp adjacent to the folded-back warp should be present and butted to the adjacent warp which has been cut at a proper portion in the normal portion. This means that a pair of two warps constitutes a loop, but the invention is not limited thereto. A warp folded back to form a loop may be interwoven with a warp portion which is not adjacent but distant from the warp or may be interwoven between two warps adjacent to each other. Even if a warp not constituting a loop is contained, weaving may be carried out similarly. A warp not constituting a loop may only be cut in the middle or end of the normal portion without folding it back.

In another embodiment according to the invention, at both ends of an industrial multilayer fabric, wefts located below two upper side wefts are removed to leave only these two upper side wefts and a common hole of upper side joining loops is formed between these two upper side wefts. The common hole of the upper side joining loops is formed by folding back all or some of upper side warps at both ends of the industrial multilayer fabric and weaving the folded-back warp in the normal portion without weaving with a lower side weft. Moreover, two common holes of lower side joining loops are formed by removing wefts located below these two upper side wefts. These two common holes are formed by folding back all or some of lower side warps at both ends of the industrial multilayer fabric and interweaving the folded-back warps in the normal portion without weaving with the remaining upper side weft. Therefore, the constitution according to the another embodiment is characterized by that three common holes of joining loops through which a core wire is to be inserted are formed between and below the remaining upper side wefts.

When the above-mentioned constitution is employed, the upper side weft and the upper side joining loop are present on the upper side of the common hole formed by engaging the joining loops with each other, that is, on the upper surface of the joining portion so that neither the joining loop nor the lower side warp placed on the lower surface side appears from the surface of the fabric.

In addition, by forming the joining loops on the upper surface side, it is possible to form a joining loop structure also on the upper surface side by hanging a part of the warp at one end of the fabric on the core wire inserted in the upper side joining loop and then folding it back and hanging a part of the warp at the other end of the other fabric on the upper side joining loop and then folding it back.

Moreover, the upper side joining loops have therebelow two common holes of the lower side joining loops. By forming two lower side joining loops, inserting two core wires therein respectively, folding back some or all of warps at one end of the fabric while hanging them on two core wires, and folding back some or all of warps at the other end of the fabric while hanging them on two core wires, it is possible to improve the joining strength at the loop formation portion of the industrial multilayer fabric and as a result, prevent extension of the loop formation portion.

The warp which has created a loop and folded back is conventionally interwoven in the site of the normal portion where an adjacent warp is to be placed and butted to a warp adjacent thereto which has been cut at an appropriate portion of the normal portion. This means that two warps constitute one loop as a pair. The invention is not limited to it, but a warp which has formed a loop and folded back may be interwoven in a warp portion which is not adjacent to but distant from the folded-back warp or may be interwoven between two warps adjacent to each other. Even if a warp not constituting a loop is contained, it may be interwoven similarly. Incidentally, it is only necessary to cut the warp not constituting a loop in the middle or end of the normal portion without folding it back.

The industrial fabric equipped with the joining loop of the invention can be formed without exposing, at the loop joining portion, yarns other than those of the upper side fabric from the surface even if the upper side fabric and the lower side fabric are constituted with respectively different yarns.

For example, in the fabric structure shown in Patent Document 2, warps constituting a loop at the loop portion are exposed from the surface of the fabric. In an industrial fabric whose upper side fabric has been constituted with a fluorine-based resin having an antifouling property as shown in Japanese Patent Application No. 2011-87484, on the other hand, a lower side warp at the loop portion is exposed from the surface of the fabric and therefore, a yarn with a low antifouling property only at this portion is exposed from the surface of the fabric. This industrial fabric is therefore not suited from the standpoint of the antifouling property which industrial fabrics should achieve.

When the joining loop structure shown in this invention is employed, even in an industrial fabric using yarns with respectively different materials for the upper side fabric and the lower side fabric, a loop portion can be formed without impairing the function of the upper side fabric because even in the loop formation portion, lower side warps are not exposed from the surface of the fabric and upper side warps and upper side wefts, and in some cases, upper side joining loops are present.

As the fabric structure for which the joining loop of the invention is used, a 2-ply warp 2-ply weft fabric obtained by joining, with a weft binding yarn, an upper side fabric composed of an upper side warp and an upper side weft and a lower side fabric composed of a lower side warp and a lower side weft and a 2-ply warp 2.5-ply weft fabric obtained by joining, with a weft binding yarn, an upper side fabric composed of an upper side warp, an upper side weft, and an upper side floating yarn and a lower side fabric composed of an upper side warp and a lower side weft. It is needless to say that when there is at least an upper side fabric, another multilayer woven structure may be employed.

A yarn to be used for the fabric of the invention may be selected freely depending on the properties which industrial fabrics are desired to have and no particular limitation is imposed on it. Examples include, in addition to monofilaments, multifilaments, spun yarns, finished yarns subjected to crimping or bulking such as so-called textured yarn, bulky yarn, stretch yarn, and Taslan yarns, and yarns obtained by intertwining them. As the cross-section of the yarn, not only circular shape but also square shape, short shape such as stellar shape, flat shape, elliptical shape, or hollow shape can be used. The material of the yarn can be selected freely and usable examples of it include polyester, nylon, polyphenylene sulfide, polyvinylidene fluoride, polypropylene, aramid, polyether ether ketone, polyethylene naphthalate, cotton, wool and metal. Of course, yarns obtained using copolymers or incorporating or mixing the above-described material with a substance selected depending on the using purpose may be used. In particular, it is preferred to use, as the upper-layer weft, flexible yarns with a great apparent diameter such as spun yarns, finished yarns subjected to crimping or bulking, or Chenille yarns because using such yarns facilitates covering the upper layer surface therewith and reduces a difference between the normal portion and the joining portion to a negligible degree when viewed from the upper layer side.

Although a yarn to be used in the invention may be selected depending on its intended use, examples of it include, in addition to monofilaments, multifilaments, spun yarns, finished yarns subjected to crimping or bulking such as so-called textured yarn, bulky yarn, and stretch yarn and yarns obtained by intertwining them. As the cross-section of the yarn, not only circular shape but also square shape, short shape such as stellar shape, elliptical shape, or hollow shape can be used. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool and metal. Of course, yarns obtained using copolymers or incorporating or mixing the above-described material with a substance selected depending on the using purpose may be used. In general, as yarns constituting a fabric for nonwoven cloth, polyester monofilaments having rigidity and excellent dimensional stability are preferably used.

Moreover, when the industrial fabric of the invention is used as an airlaid fabric, it is preferred to use a yarn made of a fluorine resin for upper side warps, upper side wefts, and upper side floating yarns that constitute the upper side fabric, and in some cases a core wire to be inserted through the upper side joining loop. As the fluorine resin, a composite resin containing fluorine having a high antifouling property may be used. For example, at least one selected from polytetrafluoroethylene resin (PTFE), tetrafluoroethylene-hexafluoropropylene copolymer (FEP), tetrafluoroethylene-perfluorovinyl ether copolymer (PFA), polyvinylidene fluoride (PVDF), ethylene-tetrafluoroethylene copolymer (FTFE), and ethylene-chlorotrifluoroethylene copolymer (ECTFE) is preferred. In particular, ETFE is suited from the standpoint of antifouling property and cost.

It is more preferred to incorporate a silicon resin in a fluorine resin raw material (water dispersion) in advance from the standpoint of flexibility. When a pigment is added in advance to a fluorine resin raw material (water dispersion), the color of the fabric surface can be changed as desired.

Furthermore, the industrial fabric having joining loops according to the invention is preferably a double layer fabric obtained by binding an upper side fabric and a lower side fabric with a weft binding yarn.

For example, when an upper side fabric is made of a fluorine resin or the like, a binding yarn can be made of a yarn, such as PET, having higher strength than that a fluorine-based resin. When a weft binding yarn is used as the binding yarn, internal binding in which no binding yarn is exposed from the surface can be employed. This means that it can prevent exposure of a yarn such as PET from the surface of the upper side fabric formed only of a fluorine resin or the like and thus, can produce a greater effect.

Moreover, an on-stack structure obtained by interweaving an upper side warp with a lower side warp and an upper side weft with a lower side weft while placing the upper one and the lower one vertically can be employed. When such an on-stack structure is employed, adhesion of fibers to a lower side fabric can be prevented more efficiently by an upper side fabric and a fabric having an improved antifouling property can be provided.

Embodiments of the invention will next be described referring to drawings.

Embodiment 1

FIG. 1 is a conceptual diagram showing one embodiment of the joining loop of the invention. In FIG. 1, all the warps of a complete design are shown. A fabric structure using the joining loop of the invention is a 2-ply warp 2.5-ply weft fabric obtained by joining, with a weft binding yarn, an upper side fabric composed of upper side warps 3, 4, 7, and 8, upper side wefts, and upper side floating yarns and a lower side fabric composed of lower side warps 5, 6, 9, 10 and lower side wefts.

At a portion where both ends of the fabric have been butted, respective upper side wefts 1 and 2 at both ends respectively are left and a loop formation portion is formed at a site where lower side wefts below them are removed. As shown in FIG. 1, the remaining upper side weft 1 corresponds to an upper side weft which has been left at the right end portion A and the remaining upper side weft 2 corresponds to an upper side weft which has been left at the left end portion B.

Figure 2:
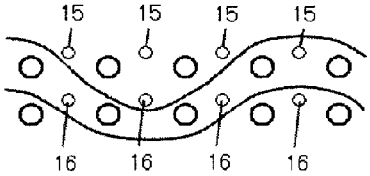
FIG. 2 is a cross-sectional view, taken along a warp, showing a weave pattern of Embodiment 1.

FIG. 2 is a cross-sectional view of warps showing the warp pattern of the end portions A, B and normal portion C of the fabric according to the present embodiment shown in FIG. 1. As shown in FIG. 2, according to the weave pattern of the present embodiment, an upper side warp goes over two upper side wefts and one upper side floating yarn 15 and goes under two upper side wefts, three upper side floating yarns, and one weft binding yarn 16. It has been found from FIG. 2 that a lower side warp goes over two lower side wefts and one weft binding yarn 16 and goes under two upper side wefts and three weft binding yarns 16.

FIGS. 3 to 6 are cross-sectional views of warps constituting a repeating unit, in a weft direction, of a joining portion in which the joining loop of the present embodiment has been formed.

Figure 3:
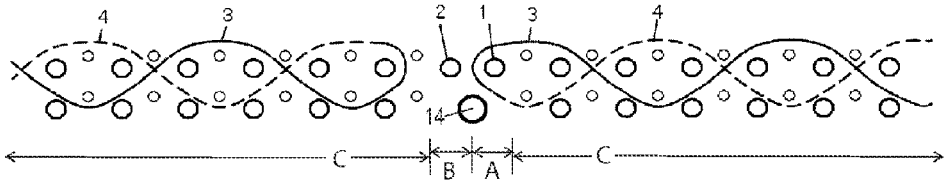
FIG. 3 is a cross-sectional view of warps constituting a repeating unit, in the width direction, of a joining portion in Embodiment 1.
Figure 4:
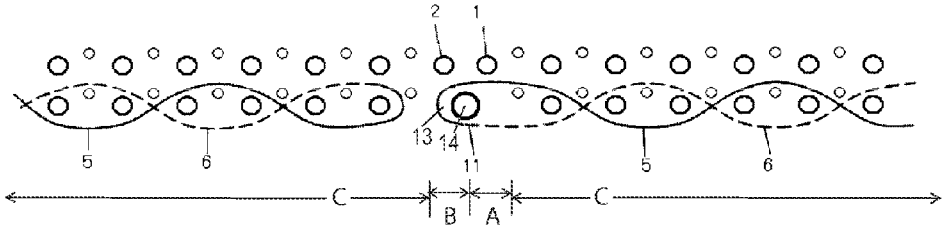
FIG. 4 is a cross-sectional view of warps constituting a repeating unit, in the width direction, of a joining portion in Embodiment 1.
Figure 5:
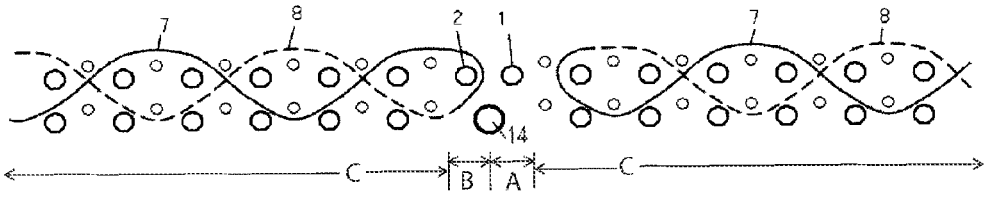
FIG. 5 is a cross-sectional view of warps constituting a repeating unit, in the width direction, of a joining portion in Embodiment 1.
Figure 6:
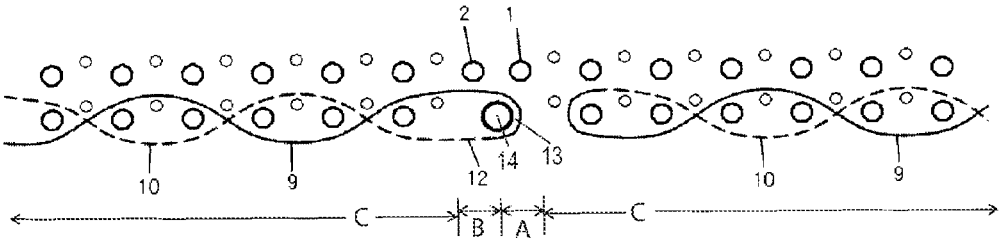
FIG. 6 is a cross-sectional view of warps constituting a repeating unit, in the width direction, of a joining portion in Embodiment 1.

Described specifically, FIG. 3 shows the interwoven state of the upper side warps 3 and 4 with wefts; FIG. 4 shows the interwoven state of the lower side warps 5 and 6 with wefts; FIG. 5 shows the interwoven state of the upper side warps 7 and 8 with wefts; and FIG. 6 shows the interwoven state of the lower side warps 9 and 10 with wefts. The interwoven states shown in FIG. 3 to FIG. 6 are arranged successively in this order in the weft direction to form a joining portion and a fabric.

In the present embodiment, the same-numbered warps at the right end portion A and at the left end portion B have been connected as one warp. Eight warps, that is, warps 3 to 10 constitute a repeating unit and two warps adjacent to each other, more specifically, upper side warps 3 and 4 shown in FIG. 3, lower side warps 5 and 6 shown in FIG. 4, upper side warps 7 and 8 shown in FIG. 5, and lower side warps 9 and 10 shown in FIG. 6 each constitute a warp pair.

This means that as the pattern shows, the upper side warp 3 is folded back and interwoven with the portion of the upper side warp 4, the lower side warp 5 is folded back and interwoven with the portion of the lower side warp 6, the upper side warp 7 is folded back and interwoven with the portion of the upper side warp 8, and the lower side warp 9 is folded back and interwoven with the portion of the lower side warp 10.

Warps originally present at the positions of the warps 4, 6, 8, and 10 adjacent to the warps 3, 5, 7 and 9 respectively are cut at some position and butted with the folded-back warps 3-4, 5-5, 7-8, and 9-10, respectively, to constitute a yarn as a whole. The folded-back warps 3-4, 5-6, 7-8, and 9-10 become warps same in the pattern as the warps originally present adjacent to the warps 3, 5, 7 and 9 respectively to constitute the fabric. For convenience of description in this specification, these yarns are sometimes expressed as the same yarns.

In FIG. 3, the upper side warp 3-4 on the right side interweaves with the remaining upper side weft 1. The upper side warp 3-4 on the left side does not interweave with the remaining upper side weft 2.

Also in FIG. 5, the upper side warp 7-8 on the left side interweaves with the remaining upper side weft 2 and is then interwoven with other upper side wefts in the normal portion C as the upper side warp 8. The upper side warp 7-8 at the right end portions A does not interweave with the remaining upper side weft 1.

As described above, the remaining upper side weft 1 at the right end portion A is interwoven by the upper side warp 3 shown in FIG. 3 and the remaining upper side weft 2 on the left side end portion B is interwoven by the upper side warp 7 shown in FIG. 5. Since the remaining upper side wefts on both ends in the width direction are interwoven once by a warp, the remaining upper side wefts do not drop off from the weave pattern.

In FIG. 4, the lower side warp 5 at the right end portion A is folded back to form a joining loop 11 and the warp 6 thus folded back is interwoven with the lower side wefts of the normal portion C.

The lower side warp 6 shown by a dotted line corresponds to a portion of the lower side warp 5 which has been folded back and interwoven in the normal portion C. In this example, the lower side warp 5-6 is interwoven, according to the weave pattern, in a portion where a warp adjacent to the lower side warp 5 should be present. The warp adjacent to the lower side warp 5 which should originally be present at the position of the lower side warp 6 is cut and butted with the lower side warp 5-6 which has also been cut, folded back, and interwoven and forms a yarn as a whole. In addition, the lower side warp 5 is twisted when it is folded back and adjusted so that the bent shape of the folded-back lower side warp 5 is made be equal to the bent shape of the warp which should originally be present adjacent to the lower side warp 5. Thus, it is engaged exactly with each weft in the weave pattern.

Needless to say, the warp which should originally be present at the portion of the lower side warp 6 may be folded back and interwoven with the lower side wefts of the normal portion C where the lower side warp 5 was originally present.

In FIG. 6, with regard to the warp at the left end portion B, the lower side warp 9 is folded back to form a joining loop 12 and the warp 10 thus folded back is interwoven with the lower side wefts in the normal portion C similar to that at the right end portion A.

The lower side warp 10 shown by a dotted line is a portion of the lower side warp 9 folded back and interwoven in the normal portion C adjacent to the lower side warp 9. Needless to say, warps forming joining loops at both ends may be either the same continuous yarn or different yarns. The joining loops to be engaged with each other may be made of the same yarn or different yarns.

A common hole 13 is formed by engaging the joining loops 11 and 12 at both end portions with each other and a core wire 14 is inserted in the common holes 13 to join these end portions. Since the remaining upper side wefts 1 and 2 are present on the upper surface side and they have therebelow joining loops, neither protrusion of the joining loops nor exposure of the lower side fabric from the upper side surface occurs.

Figure 7:
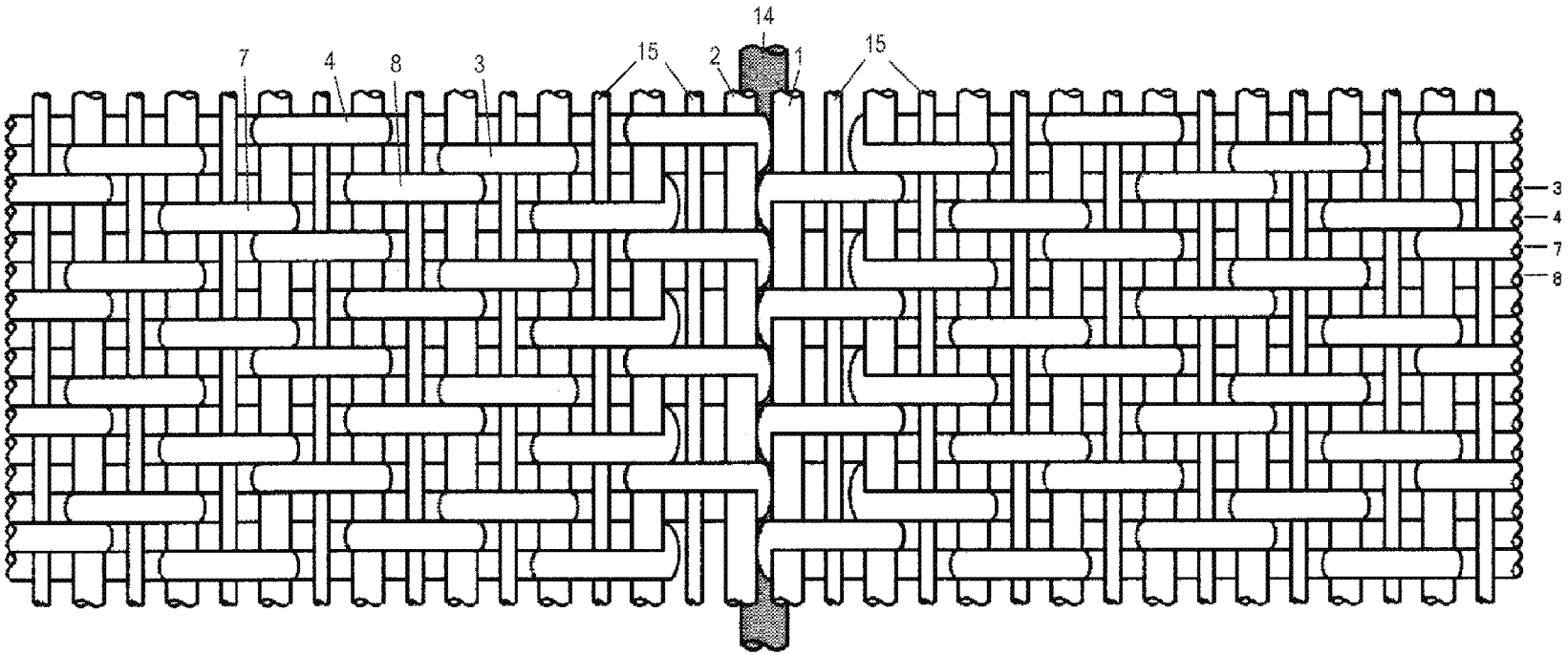
FIG. 7 is an upper-side plan view of the joining portion formed with the warps shown in from FIG. 3 to FIG. 6.
Figure 8:
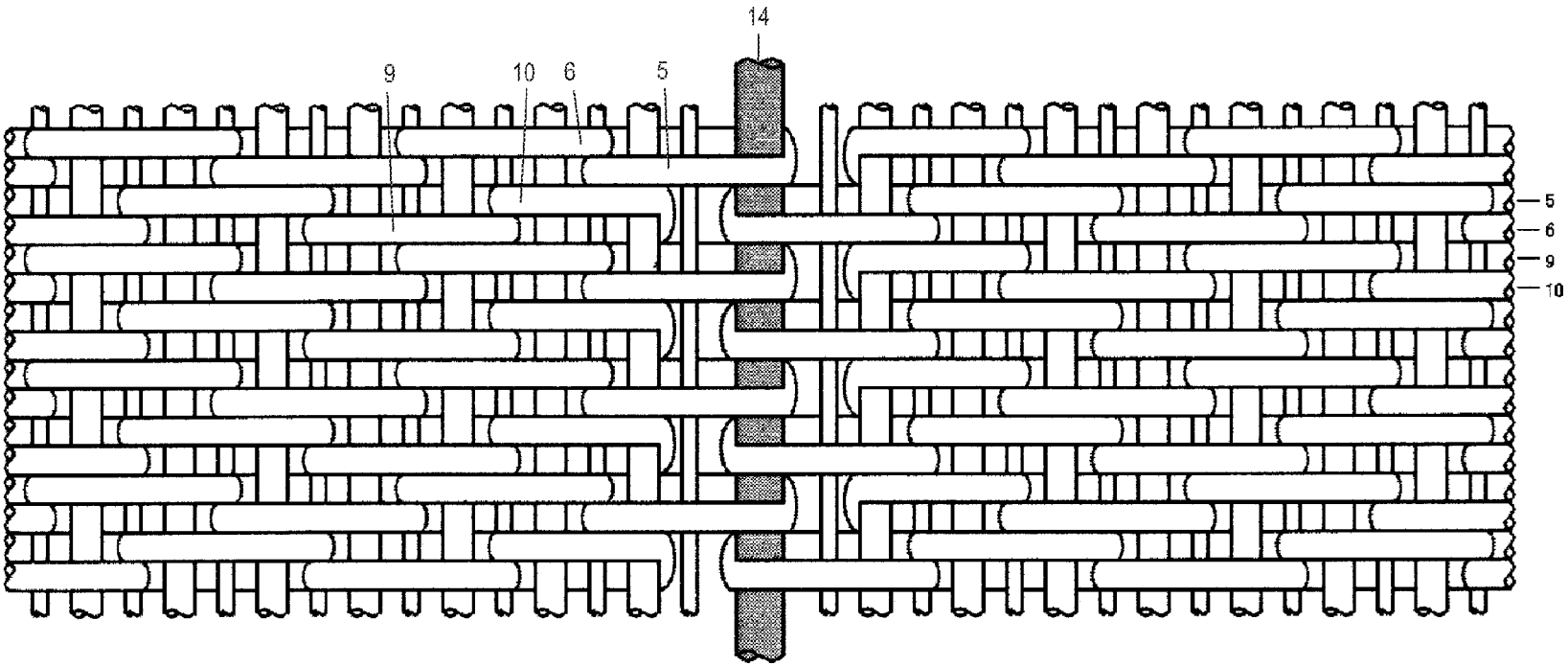
FIG. 8 is a lower-side plan view of the joining portion formed by the warps shown in from FIG. 3 to FIG. 6.

FIG. 7 is a plan view, viewed from the upper surface, of the joining portion shown in FIGS. 3 to 6 and FIG. 8 is a plan view viewed from the lower surface side. The upper side warps 3, 4, 7, and 8 shown in FIGS. 3 and 5 correspond to the upper side warps 3, 4, 7, 8 shown in FIG. 7 and the lower side warps 5, 6, 9, and 10 shown in FIGS. 4 and 6 correspond to the lower side warps 5, 6, 9, and 10 shown in FIG. 8. It can be understood clearly even from the plan view of the joining portion shown in FIG. 7 that the lower side fabric is not exposed in the loop formation portion.

The core wire 14 is completely hidden in FIG. 7, but slight opening at both ends of the loop joined portion does not pose any problem in practice. In addition, it can be understood clearly from FIG. 8 that the loop joining portion is made only of lower side warps.

The present embodiment has, as described above, the advantage that the lower side fabric is not exposed from the surface even in the loop formation portion.

The present embodiment shows one example of the joining loop of the industrial multilayer fabric according to the invention. It does not limit the scope of the invention.

Embodiment 2

Figure 9:
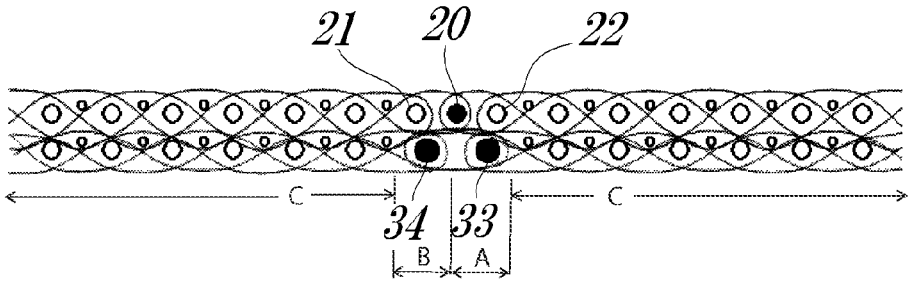
FIG. 9 is a conceptual diagram showing a joining loop according to Embodiment 2 of the invention.

FIG. 9 is a conceptual diagram showing another embodiment of the joining loop of the invention. FIG. 9 shows warps and wefts of a complete design. The fabric structure using this joining loop is a 2-ply warp 2.5-ply weft fabric obtained by joining, with a weft binding yarn, an upper side fabric made of upper side warps 23, 24, 27, and 28, upper side wefts, and upper side floating yarns and a lower side fabric made of lower side warps 25, 26, 29, and 30 and lower side wefts.

At a portion where both end portions of the fabric have been butted with each other, upper side wefts 21 and 22 at the both end portions are left and a common hole of upper side joining loops is formed between these two upper side wefts and above the site from which lower side wefts have been removed. As shown in FIG. 9, the remaining upper side wefts 21 and 22 correspond to the upper side weft 22 which has been left at the right end portion, while the remaining upper side weft 21 corresponds to the upper side weft which has been left at the left end portion.

FIGS. 10 to 14 are cross-sectional views of warps constituting a repeating unit, in the weft direction, of a joining portion at which the joining loops of the present embodiment have been formed.

Figure 10:
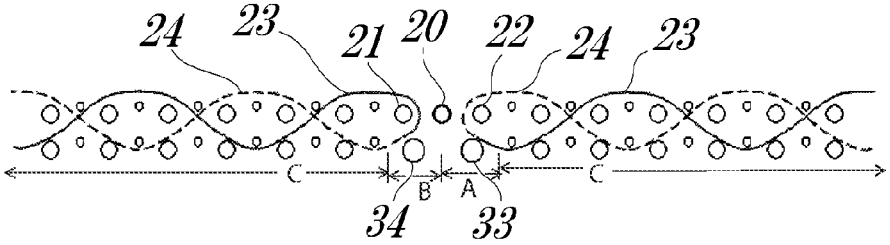
FIG. 10 is a cross-sectional view of warps constituting a repeating unit, in the width direction, of a joining portion in Embodiment 2.
Figure 11:
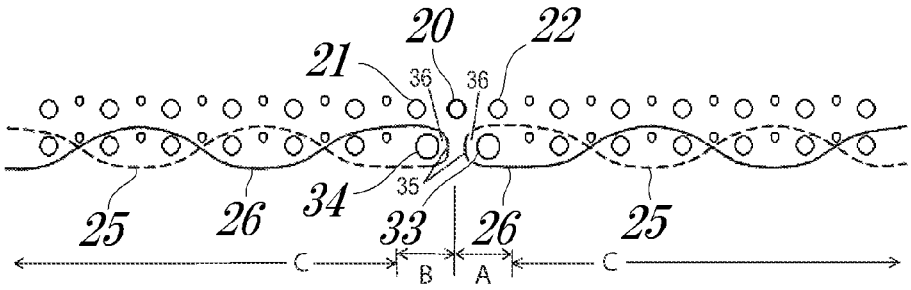
FIG. 11 is a cross-sectional view of warps constituting a repeating unit, in the width direction, of a joining portion in Embodiment 2.
Figure 12:
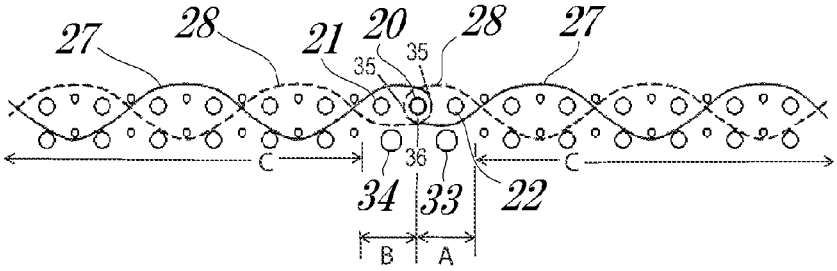
FIG. 12 is a cross-sectional view of warps constituting a repeating unit, in the width direction, of a joining portion in Embodiment 2.
Figure 13:
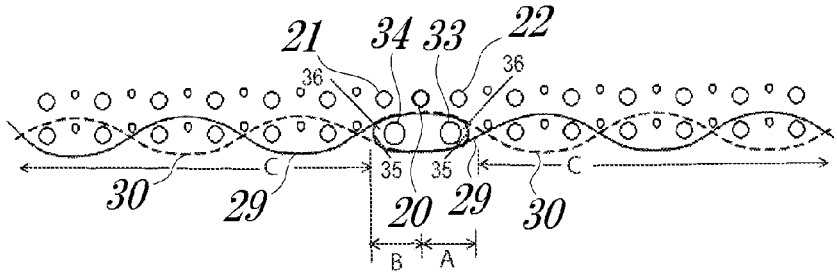
FIG. 13 is a cross-sectional view of warps constituting a repeating unit, in the width direction, of a joining portion in Embodiment 2.

Described specifically, FIG. 10 shows the interwoven state of the upper side warps 23-24 with wefts, FIG. 11 shows the interwoven state of the lower side warps 25-26 with wefts, FIG. 12 shows the interwoven state of the upper side warps 27-28 with wefts, and FIG. 13 shows the interwoven state of the lower side warps 29-30 with wefts. The states shown in FIGS. 10 to 13 are arranged successively in the weft direction to form a joining portion and a fabric.

In Embodiment 2, the same numbered warps on the left end portion B and the right end portion A constitute the same continuous warp. Eight warps 23 to 30 constitute one repeating unit.

Described specifically, as shown in FIG. 10, the upper side warp 23-24 is folded back and interwoven with upper side wefts in a normal portion C where the original upper side warp 24 was present adjacent to the upper side warp 23, the lower side warp 25-26 is folded back, as shown in FIG. 11, and interwoven with lower side wefts in a normal portion C where the original lower side warp 26 was present adjacent to the lower side warp 25, the upper side warp 27-28 is folded back, as shown in FIG. 12, and interwoven with upper side wefts in a normal portion C where the original upper side warp 28 was present, and the lower side warp 29-30 is folded back, as shown in FIG. 13, and interwoven with lower side wefts in a normal portion C where the original lower side warp 30 was present adjacent to the lower side warp 29, each as shown in the weave pattern.

Warps which are originally present in respective portions of the warps 24, 26, 28, and 30 adjacent to the warps 23, 25, 27 and 29 respectively are cut and butted with the folded-back warps 23-24, 25-26, 27-28, and 29-30, respectively, and each constitute a yarn as a whole. The folded-back warps 23-24, 25-26, 27-28, and 29-30 have the same pattern as that of warps which should originally constitute the fabric. For the convenience of description in this specification, the folded-back yarn and the originally present warp are sometimes expressed as the same yarn.

In FIG. 10, the upper side warp 24 on the right side interweaves with the remaining upper side weft 22. The upper side warp 23 on the left side interweaves with the remaining upper side weft 21.

In FIG. 12, the upper side warp 27 on the left side is interwoven with the upper side wefts in the normal portion C as the upper side warp 28 after formation of an upper side joining loop 35 through which the remaining upper side weft 21 and a core wire 20 are to be inserted. The upper side warp 28 at the right end portion A is interwoven with the upper side wefts in the normal portion C as the upper side warp 27 after formation of an upper side joining loop 35 through which the remaining upper side weft 22 and a core wire 20 are inserted.

In FIG. 11, the lower side warp 25 at the left end portion B is folded back and constitutes a lower surface side joining loop 13. The folded-back warp 26 is interwoven with the lower side wefts in the normal portion C. The lower side warp 26 at the right end portion A is folded back to form another lower side joining loop 13 and the folded-back warp 25 is interwoven with the lower side wefts in the normal portion C.

The lower side warp 26 shown by a dotted line is a portion of the lower side warp 25 folded back and interwoven in the normal portion C. In this example, the lower side warp 26 is interwoven, as shown in the weave pattern, in the portion where a warp adjacent to the lower side warp 25 is originally present. The warp which should originally be present is cut and butted with the folded-back lower side warp 25-26 to form a warp as a whole. In addition, the lower side warp 26 is twisted when it is folded back so that the bent shape of the folded-back lower side warp 26 is adjusted to be equal to the bent shape of the warp which should originally be present. Thus, it is engaged exactly with each weft in the weave pattern.

Needless to say, the warp which is originally present in a portion of the lower side warp 26 may be folded back and interwoven in a portion of the lower side warp 25.

In FIG. 13, the lower side warp 29 on the left side end portion B and the lower side warp 29 on the right end portion A are both folded back to form a lower-side joining loops 13 together and the folded-back warps 30 are interwoven with the lower side wefts in the normal portion C.

The lower side warp 30 is a portion of the lower side warp 29 folded back and interwoven in the normal portion C. Needless to say, the lower side warps 29-30 forming joining loops 13 at both ends may be the same continuous yarn or may be different yarns. The joining loops 13 to be engaged with each other may be formed of either the same yarn or different yarns.

Then, three common holes 36 of joining loops 35 through which core wires 20, 33 and 34 are to be inserted are formed between the remaining upper side wefts and below the remaining upper side wefts. Core wires 20, 33, and 34 are inserted through the joining loops 35, respectively.

Since the remaining upper side wefts 21 and 22 and the upper side joining loop 35 through which the core wire 20 is inserted are present on the upper surface side and the lower side joining loop 35 is formed therebelow, the lower-side joining loop 35 does not protrude from the upper side surface or the lower side fabric is not exposed therefrom.

Figure 14:
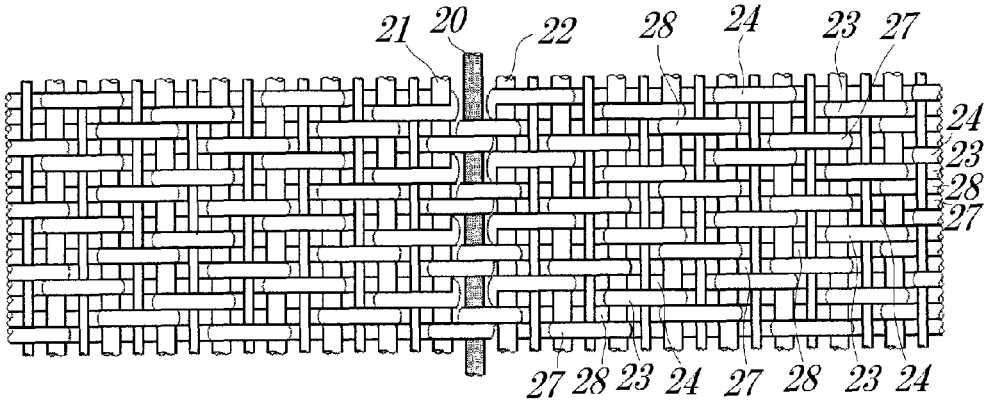
FIG. 14 is an upper side plan view of an industrial multilayer fabric having the joining loop shown in FIG. 9.
Figure 15:
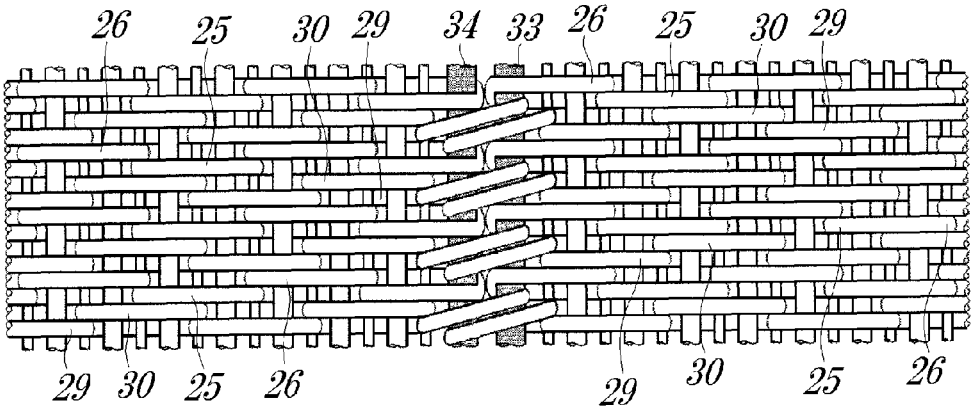
FIG. 15 is a lower side plan view of an industrial multilayer fabric having the joining loop shown in FIG. 9.

FIG. 14 is a plan view, viewed from the upper surface side, of the industrial multilayer fabric according to Embodiment 2 shown in FIG. 9; and FIG. 15 is a plan view, viewed from the lower surface side thereof.

The upper side warps 23-24 and 27-28 shown in FIGS. 10 and 12 correspond to the upper side warp 23-24 and 27-28 in FIG. 14 and the lower side warps 25-26 and 29-30 shown in FIGS. 11 and 13 correspond to the lower side warp 25-26 and 29-30 in FIG. 15. It can be understood clearly from the plan view of the joining portion shown in FIG. 14 that the lower side fabric is not exposed also in the loop formation portion.

A core wire is completely hidden in these drawings, but slight opening at both ends of the loop joining portion does not pose any problem in practice. In addition, it can be understood clearly from FIG. 15 that the loop joining portion is composed only of the lower side warp.

Embodiment 2 has, as described above, the advantage that the lower side fabric is not exposed from the surface even in the loop formation portion.

A joint strength test of the joining loop structure in Embodiment 2 was conducted. An industrial double-layer fabric employing the above-mentioned joining loop structure was manufactured and a repetitive loading cycle test was conducted under circumstance of temperature conditions of 180° C. at a tension of from 2 kN/m to 6 kN/m with 500 times of repetitive loading.

As a result, it has been confirmed that no end loss occurred. It has therefore been found that using the joining loop structure of the industrial multilayer fabric according to Embodiment 2 makes it possible to reinforce the joining strength at the loop formation portion and moreover, to prevent extension of the loop formation portion.

The preceding description has been presented only to illustrate and describe exemplary embodiments of the present joining loop structure of an industrial multilayer fabric. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A joining loop structure of an industrial multilayer fabric comprising:

wefts and warps arranged in layers;

the industrial multilayer fabric comprising, at both end portions, joining loops of some or all the end portions of warps being folded back to form at least one common hole by engaging the joining loops at the both end portions of the fabric, a core wire is inserted into the common hole;

wherein the joining loop structure is formed by leaving at least one remaining upper side weft at the both end portions and removing a lower side weft located below the remaining upper side weft;

folded back end portions of the warps are interwoven with the wefts of normal portions of the industrial multilayer fabric;

the common hole and the core wire inserted into the common hole are located below the at least one remaining upper side weft;

upper side warps do not interweave lower side wefts and lower side warps do not interweave upper side wefts;

the folded back end portions of the upper side warps are interwoven with the upper side wefts of the normal portions; and the folded back end portions of the lower side warps are interwoven with the lower side wefts of the normal portions.

2. The joining loop structure of an industrial multilayer fabric according to claim 1, the folded back end portion of an upper side warp interweaves the at least one remaining upper side weft.

3. The joining loop structure of an industrial multilayer fabric according to claim 1, some of the folded back end portions of the lower side warps are interwoven with the normal portion without forming the common hole.

4. The joining loop structure of an industrial multilayer fabric according to claim 1, the folded back end portions of the warps are butted to ends of adjacent warps in the normal portion.

5. The joining loop structure of an industrial multilayer fabric according to claim 1, wherein the joining loop structure comprises three common holes of joining loops through each of which the core wire is inserted, two of the three common holes are formed by engaging the joining loops of the upper side warps at the both end portions of the fabric, and one of the three common holes is formed by engaging the joining loops of the lower side warps at the both end portions of the fabric.

6. The joining loop structure of an industrial multilayer fabric according to claim 5, the folded back end portion of an upper side warp interweaves the at least one remaining upper side weft and forms one of the three common holes.

7. The joining loop structure of an industrial multilayer fabric according to claim 5, some of the folded back end portions of the upper side warps are interwoven with the normal portion without forming the common hole.

8. The joining loop structure of an industrial multilayer fabric according to claim 1, wherein the industrial multilayer fabric is a two-layer fabric binding an upper side fabric and a lower side fabric with a weft binding yarn.

9. The joining loop structure of an industrial multilayer fabric according to claim 8, wherein a yarn constituting the upper side fabric is made of a fluorine resin and a yarn constituting the lower side fabric is made of a yarn different from that constituting the upper side fabric.

* * * * *